United States Patent [19]

Imanaka et al.

[11] 3,933,537

[45] Jan. 20, 1976

[54] METHOD FOR PRODUCING ELECTRICAL STEEL SHEETS HAVING A VERY HIGH MAGNETIC INDUCTION

[75] Inventors: Takuichi Imanaka; Takahiro Kan, both of Chiba, Japan

[73] Assignee: Kawasaki Steel Corporation, Kobe, Japan

[22] Filed: Nov. 23, 1973

[21] Appl. No.: 418,671

[30] Foreign Application Priority Data

Nov. 28, 1972 Japan ..... 47-118524

[52] U.S. Cl. ..... 148/112; 148/111; 148/31.55; 75/123 A; 75/123 L

[51] Int. Cl.[2] ..... H01F 1/04

[58] Field of Search ..... 148/111, 110, 112, 113, 148/31.55; 75/123 A, 123 L

[56] References Cited

UNITED STATES PATENTS

| | | | |
|---|---|---|---|
| 2,209,686 | 7/1940 | Crafts | 148/111 |
| 3,096,222 | 7/1963 | Fiedler | 148/31.55 |
| 3,671,337 | 6/1972 | Kumai et al. | 148/111 |
| 3,764,406 | 10/1973 | Littmann | 148/111 |
| 3,841,924 | 10/1974 | Sakakura et al. | 148/111 |
| 3,853,641 | 12/1974 | Sakakura et al. | 148/111 |

FOREIGN PATENTS OR APPLICATIONS

| | | | |
|---|---|---|---|
| 38-8214 | 1963 | Japan | 148/111 |

OTHER PUBLICATIONS

Saito, T; *Effect of Minor Elements on Grain Growth;* in *Nihon Kinzoku*, 27 (4) 1963 pp. 186–191.

*Primary Examiner*—Walter R. Satterfield

[57] ABSTRACT

Electrical steel sheets having a very high magnetic induction are produced by a method in which an electrical steel raw material is hot rolled and annealed and subjected to at least one cold rolling and to a decarburizing annealing and a final annealing to develop the secondary recrystallized grains of (110) [001] orientation characterized in that the raw material contains less than 4.5% of Si, less than 0.06% of C, 0.005–0.100% of Sb and 0.01–0.05% of Al in the electrical steel raw material prior to the hot rolling, annealing at a temperature of 750° – 1,200°C depending upon the Si content before the final cold rolling, final cold rolling at a reduction rate of 40 – 89% and fully developing the secondary recrystallized grains at a temperature range of 800° – 950°C in the final annealing, are carried out in the above described order.

1 Claim, 5 Drawing Figures

METHOD FOR PRODUCING ELECTRICAL STEEL SHEETS HAVING A VERY HIGH MAGNETIC INDUCTION

The present invention relates to a method for producing the so-called single-oriented electrical steel sheets or strips having a high magnetic induction and an easy magnetization axis <100> in the rolling direction of the steel sheets or strips in metallurgy.

The single-oriented electrical steel sheets are mainly used as the iron core of a transformer and other electric devices. As to the magnetic characteristics, the supply of the electrical steel having a high magnetic induction and a low iron loss as well as a low magnetic striction is earnestly required by manufacturers of electrical devices.

The magnetic characteristics are generally represented by $B_8$ value, that is, the magnetic induction at 800 A/m of magnetic field and recently $B_8$ value of more than 1.85 Wb/m$^2$ is required.

An object of the present invention is to provide a method for producing electrical steel sheets or strips of $B_8$ value of more than 1.85 Wb/m$^2$.

In order to obtain the oriented silicon steel sheets having excellent magnetic properties, it is necessary that the secondary recrystallization is completely carried out in the final annealing step to fully develop (110)[001] aggregation structure. For the purpose, the growth of the primary recrystallized grains should be suppressed until the steel is brought a high temperature at which the secondary recrystallization occurs.

Suppressing the normal grain growth of the primary recrystallized grains has been generally effected by utilizing MnS, MnSe and the like. However, in such a conventional process wherein said dispersed precipitates are utilized, the aggregation of the secondary recrystallized grains of (110)[001] orientation is not sufficient and $B_8$ value of only about 1.85 Wb/m$^2$ is obtained.

Recently, AlN has been proposed as the precipitate capable of very highly aggregating the secondary recrystallized grains of (110)[001] orientation, for example, as proposed in U.S. Pat. No. 3,287,183, that is, the complementary addition of AlN combined with the usual normal grain growth inhibitor, such as S, Se or Te has made a remarkable improvement of $B_8$ value to more than 1.85 Wb/m$^2$, wherein such processes are characterized that firstly a limited high temperature annealing prior to the final cold rolling be effected in order to disperse AlN precipitate finely and secondly a final cold rolling is effected with a narrow range of high reduction. However, this process is deficient in stability in commercial production.

Another object of the present invention is to provide a method for producing electrical steel sheets having a magnetic induction of more than 1.85 Wb/m$^2$ in a commercially stable step.

The present invention consists of a method for producing single-oriented electrical steel sheets having a very high magnetic induction of $B_8$ value of more than 1.85 Wb/m$^2$ in which an electrical steel sheet raw material is hot rolled and subjected to an annealing step and at least one stage of cold rolling to obtain the cold rolled steel sheet having the final gauge. The resulting sheet is subjected to decarburization and a final annealing to develop secondary recrystallized grains of (110)[001] orientation, characterized in that 1. 0.005 – 0.10% of Sb and 0.01 – 0.05% of Al are contained in the raw material prior to the hot rolling,
2. an annealing at 750° – 1,200°C is effected depending upon the amount of Si before the final cold rolling,
3. the final cold rolling is carried out at a reduction rate of 40–89%, and
4. the secondary recrystallized grains are fully developed at a temperature of 800° – 950°C in the final annealing step.

The present invention will be explained in detail hereinafter.

The steel raw material of the present invention is melted by using the already known steel making equipment, for example, a converter, an electric furnace or an open hearth furnace which is conventional processing for electrical steel raw material. The composition is conveniently adjusted depending upon the properties of the product and then an ingot is produced by various casting processes. The molten steel to be used in the present invention may be naturally subjected to a vacuum degassing treatment, if necessary. Furthermore, the ingot may be produced by a continuous casting process.

In the present invention, any steel making processes and any casting processes can be used but the composition must satisfy the following limitation.

C : less than 0.06%
Si : less than 4.5%
Sb : 0.005–0.10%
Al : 0.01–0.05%

Al is an acid soluble Al.

When the amount of C exceeds the above described range, the decarburization in the following step takes a long time and it is not preferable in the commercial production. Therefore said amount is defined to be less than 0.06%.

In the present invention, the C content is not necessarily depend upon the Si content. This is greatly different from the teaching of said U.S. Pat. No. 3,287,183 wherein the C content influences the $B_8$ value through its fine dispersion effects on the AlN phase.

The upper limit of the Si content is limited to avoid the risk of breaks in cold rolling of the steel sheets.

The most outstanding characteristic of the raw material to be used in the present invention is in that it contains both Sb and Al.

The applicant of this invention has already disclosed in Japanese patent application Ser. No. 8,214/63 that a secondary recrystallized aggregation structure having Goss cube-on-edge orientation can be obtained by adding Sb alone to the silicon steel raw material on melting. But the addition of Al together with Sb has never been proposed.

The inventors have found that the magnetic characteristic can be noticeably improved by adding Al in addition to Sb.

Table 1

| sol. Al \ Sb | ≤0.004 | 0.005–0.010 | 0.025–0.035 | 0.05–0.10 | 0.10–0.15 |
|---|---|---|---|---|---|
| ≤0.005 | 1.56 | 1.75 | 1.82 | 1.78 | 1.68 |
| 0.010–0.025 | 1.75 | 1.89 | 1.95 | 1.88 | 1.80 |
| 0.025–0.035 | 1.78 | 1.88 | 1.93 | 1.85 | 1.79 |
| 0.040–0.050 | 1.70 | 1.85 | 1.90 | 1.84 | 1.70 |
| 0.060–0.090 | 1.65 | 1.80 | 1.84 | 1.79 | 1.70 |

unit: $B_8$ (Wb/m²), Sb, Al (Wt%)

Table 1 above shows $B_8$ value of the silicon steel sheets obtained in the following production process. To raw materials containing about 3% of Si and about 0.040% of C were added various amounts of Sb and Al and the raw materials were hot rolled to a thickness of 3 mm, cold rolled at a reduction rate of 20–80%, annealed at a temperature of 900°–1,100°C and cold rolled again at a reduction rate of 50–88% to obtain cold rolled sheets having a thickness of 0.30–0.35 mm and then the cold rolled sheets were decarburized in a wet hydrogen at 820°C and finally annealed at 870°C for 30 hours to grow the secondary recrystallized grains fully and successively annealed at 1,200°C for 5 hours to obtain silicon steel final products.

As seen from Table 1 above, the electrical steel sheets of the present invention having $B_8$ value of more than 1.85 Wb/m² can be obtained only within a range of Sb of 0.005–0.10% and Al of 0.01–0.05%. Beyond the range, that is, when the amount of Sb and Al is too much or too small, the aimed $B_8$ value can not be obtained and said $B_8$ value at most exceeds 1.80 Wb/m² slightly, because the secondary recrystallization occurs incompletely or even if the secondary recrystallization occurs completely, the aggregation of the secondary grains of (110)[001] orientation is insufficient.

For the above described reason, it is essential in the present invention to use the raw material containing both 0.005–0.10% of Sb and 0.01–0.05% of Al.

Concerning the composition other than the above described C, Si, Sb, and Al, there is no particular limitation as far as the composition does not influence upon the annealing condition, the cold rolling condition and particularly the temperature condition at which the secondary recrystallized grains are developed, as mentioned hereinafter. Particularly, Mn should be contained in an amount of about 0.02–0.20% in view of the hot shortness in the hot working.

The raw material (ingot or slab) having the composition satisfying the above described requirements is hot rolled. In the previously known process, the temperature for heating the slab prior to the hot rolling must be strictly controlled for, firstly, dissolving the solid and then reprecipitating of fine MnS or MnSe. For example, the slab must be generally heated at a temperature higher than 1,300°C, when MnS or MnSe precipitates are utilized.

On the other hand, as mentioned above, the present invention uses both Sb and Al as an inhibitor of primary grain growth. When Sb is used as the inhibitor, the temperature for heating the slab does not always need to be as high as over 1,300°C. The function of Sb in inhibiting the primary grain growth is not through the precipitated dispersion phase, such as MnS or MnSe, but Sb itself as the solute atom has the inhibiting function. In the present invention wherein Sb is contained, the temperature for heating the slab may be a relatively low temperature of about 1,200°–1,300°C and therefore the durable life of the heating furnace is prolonged and the unevenness of the product properties due to uneven burning of the slab can be prevented.

The hot rolled sheets having a thickness of 2–4 mm through the hot rolling step are successively subjected to at least one cold rolling step to obtain the final gauge. In this case it is necessary to effect an annealing or an intermediate annealing between a cold rolling and a cold rolling of the hot rolled sheet, so as to make the aggregation structure of the crystallized grains prior to the final cold rolling as near as possible into a random state.

The temperature of the annealing or the intermediate annealing between the cold rollings depends upon the amount of Si and as said amount increases, the temperature is to be raised and for example, in the case of 3% silicon steel the temperature is preferred to be 850°–1,200°C.

FIG. 1 shows an influence of the annealing temperature on the aggregation structure of the crystallized grains in an annealed hot rolled sheet having a thickness of 3 mm and containing 2.95% of Si, 0.030% of Sb and 0.020% of Al. The abscissa of this diagram shows the annealing temperature after the hot rolling and the ordinate shows the ratio of X-ray reflection strength of the annealed hot rolled sheet to be tested with respect to X-ray reflection strength of a standard sample in which all the crystallized grains are in the random state. This X-ray reflection strength test was effected with respect to the crystallized grains in the surface of the hot rolled sheet and the crystallized grains in the center of the sheet which are exposed by grinding the hot rolled sheet. In general, as the X-ray reflection strength ratio approaches 1, the aggregation structure of the crystallized grains approaches to the standard sample and the structure is homogenized in the random orientation. Accordingly, it can be seen from FIG. 1 that the homogenizing occurs within a range of 850°–1,200°C of the annealing temperature.

The same results can be obtained also in the case of the intermediate annealing after the primary cold rolling.

FIG. 2 shows the relation of the magnetic property of the final products obtained as described hereinafter to the homogenizing annealing temperature. The hot rolled sheet (A) having a thickness of 2.4 mm and containing 2.90% of Si, 0.020% of Sb and 0.028% of Al and the hot rolled sheet (B) having a thickness of 2.4 mm and containing 2.90% of Si, 0.020% of Se and 0.025% of Al are subjected to the homogenizing annealing at various temperatures and then the annealed sheets are cold rolled at a reduction rate of 85% to obtain the cold rolled sheet having a thickness of 0.35 mm and subjected to a decarburizing annealing and to a secondary recrystallizing annealing at 850°C for 50 hours and a final annealing at 1,180°C. Namely, the curve A in FIG. 2 relates to the electrical steel sheet of the present invention containing Sb and Al and a very high $B_8$ value can be obtained at a relatively broad range of homogenizing annealing temperature of 850°–1,150°C in the present invention, while when Sb is not contained, the homogenizing annealing temperature showing the high $B_8$ value is limited with a relatively narrow range of about 1,100°C as shown in the curve B. Such a broad range of the homogenizing annealing temperature as in the present invention can not be attained by the prior arts, such as using AlN together with S or Se, and this is one characteristic of the present invention.

In the present invention, the cold rolling may be effected at least once but in any case the reduction rate of the final cold rolling must be 40–89%. FIG. 3 is a diagram showing the relation of $B_8$ value to the reduction rate with respect to the steel sheets obtained by the following manner. The hot rolled sheets having a thickness of 3 mm and 2 mm, respectively, each of which contains 2.9% of Si, 0.02% of Sb, and 0.017% of Al, were subjected to a primary cold rolling and a secondary cold rolling at various combinations of reduction rates to obtain the final gauge of 0.3 mm with an intermediate annealing at a temperature of 900°–1,050°C. The resulting sheets were subjected to a decarburizing annealing and then to a secondary crystallizing annealing at 870°C for 50 hours and a purifying annealing at 1,150°C for 5 hours. 1R and 2R in FIG. 3 show the primary cold rolling reduction rate and the secondary cold rolling reduction rate, respectively. Accordingly, only the combination of 1R: 0% and 2R: 90% concerning the hot rolled sheet having a thickness of 3 mm and the combination of 1R: 0% and 2R: 85% concerning the hot rolled sheet having a thickness of 2 mm correspond to one stage cold rolling and all the other combinations show the two stage cold rolling process. Thus, in the former 90% and 85% correspond to the final cold rolling reduction rate, respectively and in the latter the reduction rates in 2R correspond to the final cold rolling rates. As seen from FIG. 3, in both the hot rolled sheets having a thickness of 3 mm and 2 mm, $B_8$ value of more than 1.85 Wb/m² can be obtained within the range of the final cold rolling reduction rate of 40–89%. In this case, it has no direct influence on the effectiveness of the present invention whether the primary cold rolling is effected or not and the reduction rate of the primary cold rolling reduction rate also has no influence on the effectiveness.

It has never been found in the previously proposed processes that as in the present invention, $B_8$ value of more than 1.85 Wb/m² can be obtained in such a broad range of the final cold rolling reduction rate and this effect is caused by the specific composition in the raw material and a relatively low temperature annealing for the secondary recrystallization as mentioned hereinafter. Furthermore, as shown in FIG. 3, in the present invention the stable $B_8$ value can be obtained at a broad range of reduction rate irrelative to the thickness of the hot rolled sheet. And these effects are highly commercially valuable.

Another characteristic of the present invention lies in the final annealing successive to the decarburizing annealing.

So far, this final annealing has been effected at a high temperature higher than 1,000°C for simultaneously attaining of growing the secondary recrystallized grains and removing the impurities (mainly Se, S and N) in the sheets.

In the present invention, the growth of the secondary recrystallized grains and the removal of the impurities are effected at separate temperature zones. That is, the secondary recrystallization is effected at a temperature as low as possible and then the removal of the impurities is effected at a relatively high temperature.

FIG. 4 shows a relation of the annealing temperature to the ratio of secondary recrystallization and $B_8$ value of the steel sheets obtained by applying the treatments as described hereinafter to the hot rolled raw materials A, B and C having the compositions as shown in the following Table 2.

Table 2

| | C | Si | Al | Sb | Se | S |
|---|---|---|---|---|---|---|
| A | 0.030 | 2.91 | 0.020 | 0.021 | trace | 0.003 |
| B | 0.037 | 2.88 | 0.025 | 0.002 | 0.022 | 0.005 |
| C | 0.028 | 2.95 | 0.003 | 0.002 | 0.013 | 0.003 |

unit: Weight%

In the above Table 2, the raw material A relates to the present invention and the raw material B does not contain the amount of Sb defined in the present invention and the raw material C does not contain the amounts of Al and Sb defined in the present invention.

The above described raw materials A and B were treated in the following manner. These silicon steel sheet raw materials were subjected to a final cold rolling at a reduction rate of 83% after an intermediate annealing at 1,050°C for 2 minutes to obtain sheets having a thickness of 0.35 mm. The cold rolled sheets were subjected to a decarburizing annealing in a wet hydrogen at 850°C and then to a secondary recrystallizing annealing at various temperatures as shown in FIG. 4 for 10 hours.

The above described raw material C was treated in the previously known processes until the decarburizing annealing. That is, the raw material was subjected to an intermediate annealing at a temperature of 950°C and to a cold rolling at a reduction rate of 50% to a thickness of 0.35 mm and then to a decarburizing annealing at 820°C and a secondary recrystallizing annealing at various temperatures as shown in FIG. 4 for 10 hours.

FIG. 5 shows the results when the secondary recrystallizing treatments were effected for 80 hours.

As seen from FIGS. 4 and 5, in the conventional 3% silicon steels, B and C, at the temperature range of 800°–950°C, the secondary recrystallization can not occur or even if occurs, the desired $B_8$ value can not be obtained, while in the steel sheet obtained from the raw material A of the present invention, about 100% of the ratio of secondary recrystallization is obtained at a relatively low temperature of 830°–950°C in both FIGS. 4 and 5, that is, the secondary recrystallization is substantially completed and a high $B_8$ value can be obtained.

It is a characteristic of the present invention that the secondary recrystallization can be fully developed at such a relatively low temperature range. The higher $B_8$ value can be obtained by suitably selecting the secondary recrystallizing temperature incorporating with the composition of the raw material, the temperature in the intermediate annealing and the final cold rolling reduction rate as defined in the present invention.

The temperature for causing the secondary recrystallization at such a low temperature range varies depending upon the Si content and when the Si content is low, the secondary recrystallization occurs at about 800°C, while when the Si content is high, the higher temperature is necessary. However, as seen from FIGS. 4 and 5, if the secondary recrystallizing temperature exceeds 950°C, $B_8$ value lowers. Consequently, the secondary recrystallizing temperature in the present invention is limited to 800°-950°C.

The time necessary for fully developing the secondary recrystallization is usually 5-120 hours, but this time may vary depending upon the temperature, heating mode and the like.

The characteristic of the present invention in the final annealing resides in that the secondary recrystallized grains are fully developed and as far as this object can be attained, the heating mode may be "holding the temperature" or "gradual raising temperature".

According to the present invention, the magnetic induction $B_8$ value is satisfactorily high at the stage when the secondary recrystallization is completed. Accordingly, when the electrical steel sheets only having a high $B_8$ value are required, the final annealing may be interrupted at this stage. In general, however, a product having not only a high magnetic induction but also a low iron loss is required and for the purpose it is necessary to decrease the impurities in the steel, particularly N. Thus, the temperature is preferably raised to a relatively high temperature, such as 1,200°C, immediately after the secondary recrystallizing annealing.

For a better understanding of the invention, reference is taken to the accompanying drawings, wherein.

Figure 1:
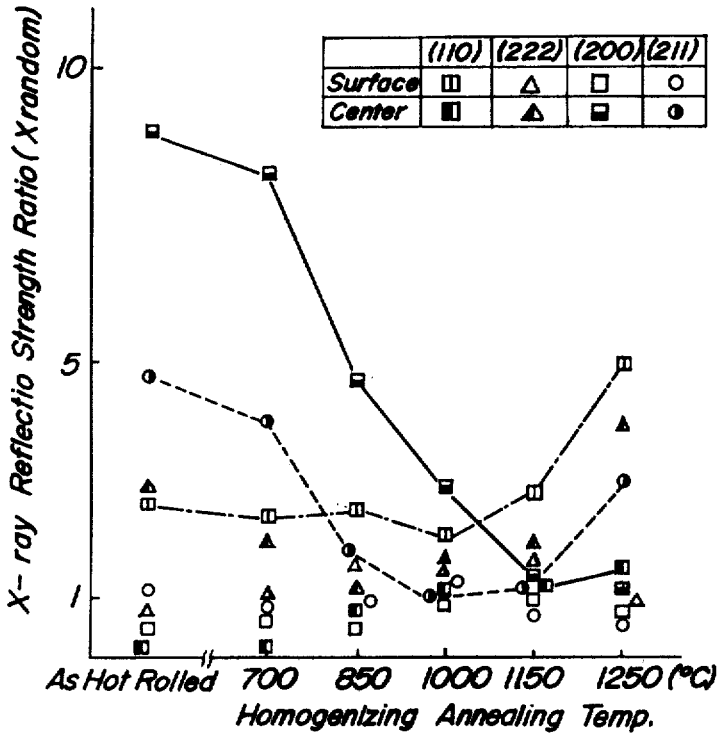
FIG. 1 is a diagram showing a relation of the homogenizing annealing temperature of the silicon steel containing the composition defined in the present invention to the X-ray reflection strength ratio of the annealed sheets.
Figure 2:
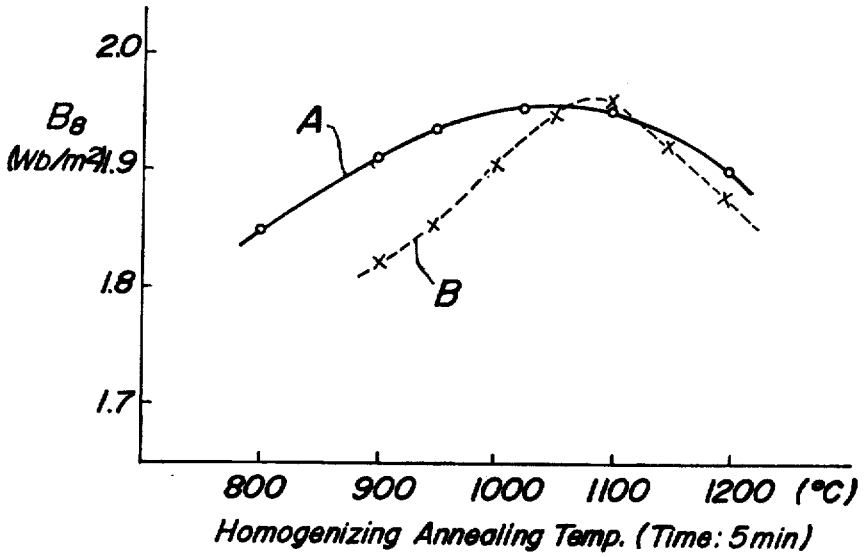
FIG. 2 is a diagram showing a relation of the homogenizing annealing temperature to $B_8$ value with respect to the silicon steel containing the composition according to the present invention and the silicon steel containing no such composition.
Figure 3:
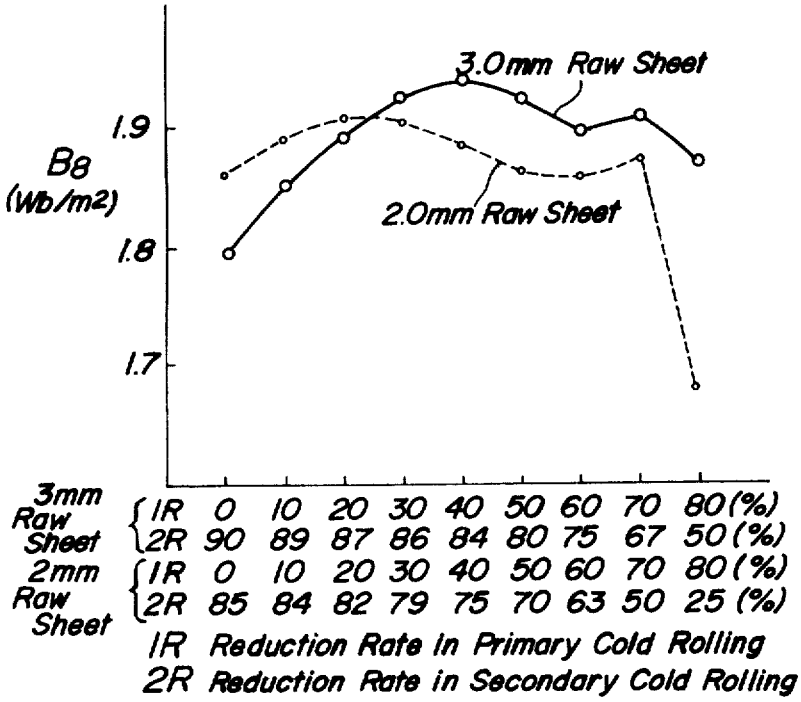
FIG. 3 is a diagram showing a relation of various final cold rolling reduction rates to $B_8$ value with respect to the hot rolled sheets having a thickness of 3 mm and 2 mm.
Figure 4:
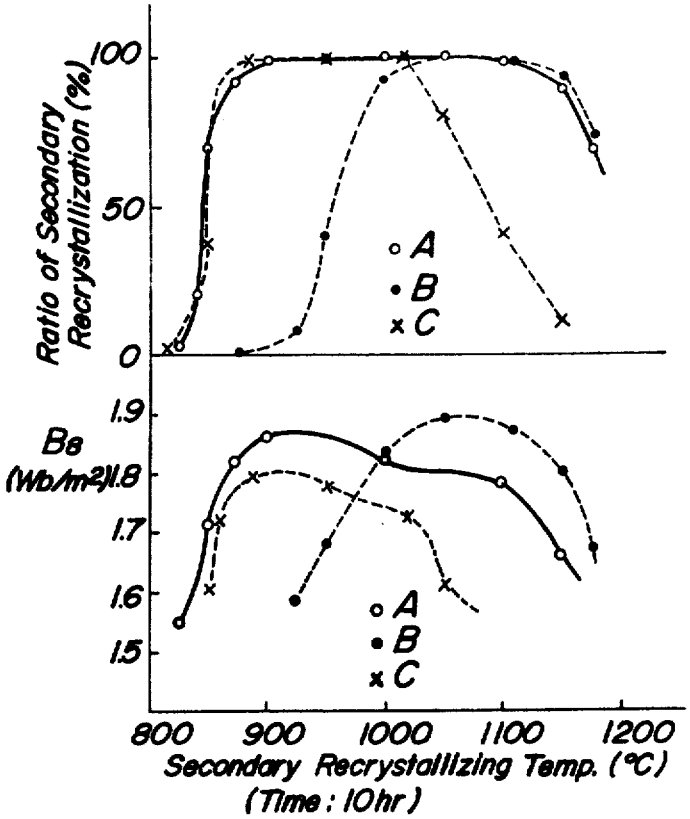
Figure 5:
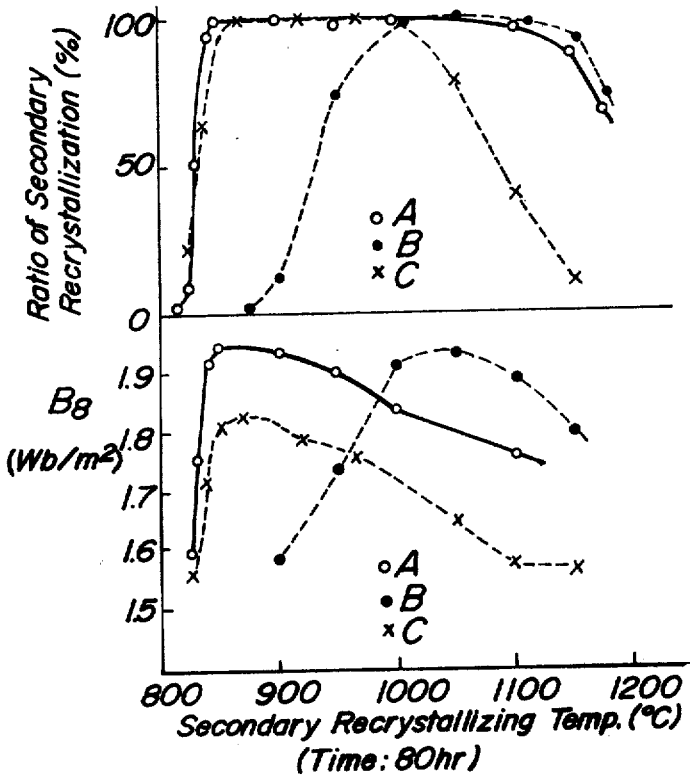

FIG. 4 is a diagram showing a relation of the secondary recrystallizing temperature to the ratio of secondary recrystallization and $B_8$ value with respect to silicon steels obtained by applying the given treatments to the hot rolled sheet raw materials having the compositions as shown in Table 2; and FIG. 5 is a diagram showing the results obtained when the annealing time is longer than the case of FIG. 4.

The following examples are given for the purpose of illustration of this invention and are not intended as limitations thereof. The term "%" used herein means by weight.

EXAMPLE 1

A silicon steel ingot containing 0.040% of C, 2.90% of Si, 0.030% of Sb and 0.025% of Al was bloomed and then heated at 1,250°C for 1 hour followed by continuous hot rolling step to 3 mm thickness, cold rolled at a reduction rate of 75%, then annealed at 1,000°C for 5 minutes, and again cold rolled at a reduction rate of 60% to 0.3 mm thickness. Then, the sheet was decarburized in a wet hydrogen at 820°C for 5 minutes and final annealed. In case of the final annealing, a temperature of 870°C was maintained for 50 hours to develop the secondary recrystallized grains fully and then the temperature was raised to 1,180°C and maintained for 5 hours. The magnetic characteristic of the resulting product was as follows.

$B_8$ : 1.90 Wb/m²

EXAMPLE 2

A silicon steel ingot containing 0.040% of C, 2.90% of Si, 0.020% of Sb and 0.022% of Al was bloomed and then heated at 1,320°C for 1 hour followed by continuous hot rolling step to 3.0 mm thickness, cold rolled at a reduction rate of 50% and then annealed at 950°C for 5 minutes. After this annealing the sheet was cooled from 950°C to 450°C during 300 seconds. Then, the annealed sheet was cold rolled at a reduction rate of 80% to obtain a final gauge of 0.30 mm. Then a decarburizing annealing was carried out at 820°C for 5 minutes and the final annealing was effected. In the final annealing, a temperature of 850°C was maintained for 70 hours to develop the secondary recrystallized grains fully and then the temperature was raised to 1,200°C, which was maintained for 5 hours. The $B_8$ value of the resulting product was 1.92 Wb/m².

EXAMPLE 3

A silicon steel ingot containing 0.040% of C, 2.95% of Si, 0.019% of Sb, 0.020% of Al and 0.055% of Mn was hot rolled to 2.4 mm thickness, annealed at 960°C for 5 minutes, cold rolled at a reduction rate of 85%, and subjected to a decarburizing annealing and a final annealing. In the final annealing, the temperature was raised from 800°C to 1,000°C at a heating rate of 7°C/hr to develop the secondary recrystallized grains fully and a temperature of 1,180°C was maintained for 5 hours. The $B_8$ value of the resulting product was 1.91 Wb/m².

EXAMPLE 4

A silicon steel ingot containing 0.021% of C, 2.93% of Si, 0.035% of Mn, 0.023% of Sb, 0.022% of Al and 0.004% of S was hot rolled to 3 mm thickness, cold rolled at a reduction rate of 50%, annealed at 900°C for 7 minutes and again cold rolled at a reduction rate of 80% to obtain a final gauge of 0.30 mm. Then, the decarburizing annealing was carried out at 820°C for 10 minutes and immediately the secondary recrystallizing annealing was effected at 870°C for 6.5 hours and then the purifying annealing was effected at 1,000°C for 6 hours. The $B_8$ value of the resulting product was 1.91 Wb/m².

EXAMPLE 5

A silicon steel ingot containing 0.040% of C, 2.90% of Si, 0.020% of Sb and 0.020% of Al was hot rolled to 2.4 mm thickness, annealed at 1,000°C for 5 minutes, cold rolled at a reduction rate of 85% and then subjected to a decarburizing annealing and a final annealing. In the final annealing, a temperature of 860°C was maintained for 50 hours to develop the secondary recrystallized grains fully and then the temperature was raised to 1,180°C, which was maintained for 5 hours. The $B_8$ value of the resulting product was 1.95 Wb/m².

EXAMPLE 6

A silicon steel hot rolled sheet (3.0 mm thickness) containing 0.030% of C, 2.90% of Si, 0.015% of Sb and 0.022% of Al was cold rolled at a reduction rate of 40%, annealed at 1,050°C and again cold rolled at a reduction rate of 84% to obtain a final gauge of 0.30 mm. A decarburizing annealing was carried out and then a final annealing was effected. In the final annealing a temperature of 860°C was maintained for 70 hours to develop the secondary recrystallized grains fully and the temperature was raised to 1,180°C, which was maintained for 5 hours. The $B_8$ value of the resulting product was 1.93 Wb/m².

EXAMPLE 7

A silicon steel ingot containing 0.032% of C, 0.82% of Si, 0.033% of Mn, 0.027% of Sb, 0.019% of Al and 0.004% of S was hot rolled to 2.0 mm thickness, cold rolled at a reduction rate of 20%, annealing at 900°C for 5 minutes and again cold rolled at a reduction rate of 82% to obtain a final gauge of 0.30 mm. A decarburizing annealing was carried out at 790°C for 5 minutes and a secondary recrystallizing annealing was carried out at 800°C for 90 hours and a purifying annealing was effected at 890°C for 5 hours. $B_8$ value of the resulting product was 1.98 Wb/m².

As mentioned above, the present invention can produce electrical steel sheets having a magnetic induction $B_8$ value of more than 1.85 Wb/m² in a stable industrial step.

What is claimed is:

1. In a method for producing electrical steel sheets having a very high magnetic induction in which an electrical steel raw material is hot rolled, annealed at a temperature of 750°–1200°C the sheet is subjected to at least one cold rolling including, at least a final cold rolling, at a reduction rate of 40–89% to produce a steel sheet having a final gage of 2–4mm, with said 750°–1200°C annealing occurring before said final cold rolling, said cold rolled sheet being subjected to a decarburizing annealing and a final annealing to develop the secondary cyrstallized grain of (110) [001]; the improvement comprising utilizing an electrical steel raw material consisting of less than 4.5% Si, less than 0.06% C, 0.025–0.035% of Sb, 0.01–0.035% of soluble Al, 0.02–0.20% of Mn with the remainder of the composition comprising iron and incidental impurities and the improvement further comprising subjecting the sheet to a final annealing at a temperature of 800°–950°C for from 5 to 120 hours to develop the secondary recrystallized grains of (110) [001] orientation and then subjecting said sheet to a subsequent purifying annealing at a temperature higher than 1000°C to remove the impurities.

* * * * *